United States Patent [19]

Turner

[11] 4,456,359

[45] Jun. 26, 1984

[54] FLAT PHOTOGRAPHIC SHEET PROCESSING CASSETTE

[75] Inventor: George F. A. M. Turner, Ingatestone, England

[73] Assignee: Ciba-Geigy AG, Basel, Switzerland

[21] Appl. No.: 436,908

[22] Filed: Oct. 27, 1982

[30] Foreign Application Priority Data

Nov. 4, 1981 [GB] United Kingdom ..... 8133192
Nov. 4, 1981 [GB] United Kingdom ..... 8133193

[51] Int. Cl.[3] ..... G03D 3/02

[52] U.S. Cl. ..... 354/312; 354/324; 354/344

[58] Field of Search ..... 354/312, 316, 323, 324, 354/331, 337, 315, 340, 344, 276

[56] References Cited

U.S. PATENT DOCUMENTS

| | | | |
|---|---|---|---|
| 1,072,792 | 9/1913 | Tobias | 354/312 |
| 1,879,498 | 9/1932 | Richards et al. | 354/276 |
| 2,226,438 | 12/1940 | Moore | 354/337 |
| 3,538,835 | 11/1970 | Needleman | 354/324 |
| 3,886,575 | 5/1975 | Gall | 354/311 |
| 4,168,899 | 9/1979 | Klass | 354/315 |
| 4,291,968 | 9/1981 | Work | 354/316 |

FOREIGN PATENT DOCUMENTS

| | | |
|---|---|---|
| 333504 | 11/1903 | France . |
| 368677 | 12/1906 | France . |
| 430920 | 11/1911 | France . |
| 245703 | 10/1947 | Switzerland . |

*Primary Examiner*—A. A. Mathews
*Attorney, Agent, or Firm*—Harry Falber

[57] ABSTRACT

The cassette is formed by a floor panel (1) and a top panel (20) which fit into each other by means of side walls (2 resp. 13). The top panel (20) being pivotally mounted on the floor panel (1) at one end of the cassette and being held in contact with the floor panel by a resilient band (30) which surrounds the cassette so that the other end of the cassette can be opened to allow a sheet of photographic material to be inserted into the cassette or removed therefrom by inverting the cassette. There being present light-sealing means along both sides of the cassette and there being present light-sealing but liquid permeable means (23, 3) at both ends of the cassette.

The processing device for the cassette comprises at least one slim open-ended flat-sided sheath into which a slim cassette can just be fitted. There being present in the sheath means for preventing the cassette(s) from sitting on the bottom of the device. There being further present pump means attached to the device which is adapted to pump liquid from the bottom of the device and discharge it at the top of the sheath(s).

11 Claims, 7 Drawing Figures

FLAT PHOTOGRAPHIC SHEET PROCESSING CASSETTE

This invention relates to a photographic sheet processing device.

Many photographers like to process and print their own photographs but are deterred from doing so by the expense of providing a dark room. Thus recently there have been developed printing and processing methods which can be carried out in a normally lit room such as a kitchen or a bathroom which need not be blacked out. To enable this to be done there have been introduced photographic enclosed frame enlargers which can be used under normal lighting conditions. It is one object of the present invention to provide a photographic print material cassette which can be loaded after exposure in one of these enlargers and which can then be processes outside the enlarger in daylight or normal lighting conditions.

There have been described thin cassettes in which photographic sheet material can be processed. For example such cassettes are described in French patent specifications 333504, 368677 and 430920 and also an X-ray film cassette in U.S. Pat. No. 1,879,498 but in all these cases the cassette requires to be loaded in a dark room and could not be loaded in the confined space of an enclosed frame enlarger.

According to the present invention there is provided a photographic sheet material processing cassette which is composed of a light opaque material, and which comprises a substantially flat floor panel with upstanding side flanges along two parallel sides and a substantially flat top panel which fits within the side flanges in the floor panel but which otherwise covers the floor panel, the floor and top panels together with their side walls forming a cassette in which a sheet of photographic material can be accomodated, the top panel being pivotally mounted on the floor panel at one end of the cassette and being held in contact with the floor panel by a resilient band which surrounds the cassette so that the other end of the cassette can be opened sufficiently to allow a sheet of photographic material to be inserted into the cassette or removed therefrom by inverting the cassette, there being present light-sealing means along both sides of the cassette and there being present light-sealing but liquid permeable means at both ends of the cassette.

Preferably the resilient band surrounds the cassette towards the end at which the cassette pivots. Preferably the resilient band is located in a recess in the floor panel of the cassette and in notches in the side flanges on the floor panel.

Most preferably the resilient band is an elastic or rubber band.

Preferably the light opaque material is polystyrene, polypropylene or acrylonitrile-butadiene-styrene loaded with carbon black.

Preferably the light sealing means along the sides of the cassette comprises a flange along both side edges of the lid panel of the cassette which cooperate with internal flanges on the floor panel.

Preferably the light sealing but liquid permeable means at the cassette opening end comprises two pairs of upstanding V-shaped members; one pair on each panel fit into the other pair when the cassette is closed.

Preferably the pivotal mounting of the top panel in the floor panel comprises a trough in the floor panel into which a flange on the top panel fits. This together with an external flange on the top panel constitutes also the light-sealing but liquid permeable means at this end of the cassette.

Preferably the sheet material is inserted in the cassette so that the photosensitive surface faces the underside of the top panel. Most preferably the cassette is so formed that when the photosensitive sheet is present in the cassette its end closest to the entry port lies on the upslope of a V-shaped member on the floor panel so that when the cassette is held with the opening end facing upwards and processing liquid enters this end it flows down over the photosensitive side of the sheet.

The present invention also includes a cassette as just defined and a device in which the cassette can be placed for processing material in the cassette.

Various enclosed film and paper processing tanks with liquid recirculation means therein have been described for example in U.S. Pat. Nos. 2,226,438 and 3,538,835 but neither of these could be used to process the cassette of the present invention loaded with a sheet of photographic material. Nor could be bath of Swiss Pat. No. 245703.

In U.S. Pat. No. 3,886,575 there is described a device in which cassettes loaded with photographic material can be processed. However the cassettes of U.S. Pat. No. 3,886,575 are of an entirely different type to the cassettes of the present invention and contain a plurality of frames each holding sheet of photographic material. The device of U.S. Pat. No. 3,886,575 comprises drive means, lifting means and even a computer and is in an entirely different order of magnitude to a device required to process the slim simple cassettes of the present invention.

According to this aspect of the present invention there is provided the combination of a cassette as just defined and a processing device which comprises at least one thin open-ended flat-sided sheath into which one cassette can just be fitted, there being present in the sheath means for preventing the cassette from resting on the bottom thereof, there being present pump means attached to the device which is adapted to pump liquid from the bottom of the device and discharge it at the top of the sheath.

In one embodiment of the invention the processing device comprises a single sheath with an attached pump.

Preferably in this embodiment the pump is located at one side of the sheath at the top of a liquid channel.

In another embodiment the processing device comprises at least three sheaths arrange in seriatim in parallel across a container. An odd number of sheaths is preferred as this helps the liquid flow in the device. Preferably the pump is in a channel attached to the device.

In this embodiment preferably the channel is part of an end compartment of the device parallel to the sides of the sheaths.

In one embodiment in which there are an odd number of sheaths the liquid is pumped so that it enters the sheath most remote from the pump at the top of the sheath, enters the next sheath at the bottom, enters the next sheath at the top and leaves the next sheath at the bottom and so on in pairs until it is sucked up a channel at the top of which the pump is located.

Preferably a handle is attached to each cassette in the device for lowering the cassette into the sheath and for lifting the cassette out of the sheath.

An example of a suitable pump is a ball-pump located at the top of the channel and which sucks up liquid from the bottom of the sheath and discharges it towards the top of the sheath.

An example of another suitable pump is a battery-driven archimedes screw pump which is located at the top of the channel, there being present in the channel vertical reacting members which are parallel to the axis of the screw. By use of this pump liquid present at the bottom of the sheath can be sucked up by the pump and discharged towards the top of the sheath.

In practice the sheath (or sheaths) is of such a size that the thin cassette slips completely into the sheath with only a handle protruding, with the sheet entry port of the cassette upper-most.

Preferably in the embodiment which comprises a single sheath the processing liquid is pumped from the bottom of the sheath to the top of the channel and is discharged at level of the entry-port of the cassette and flows across the end of the cassette through the liquid permeable entry port.

Preferably in the embodiment which comprises a plurality of sheaths when the processing liquid is pumped from the bottom of the device to the top of the channel it is discharged along a channel so that it reaches the cassette furthest away from the pump, it flows across the entry port of the cassette and down through the cassette processing the material therein. It then reaches the floor of the device and flows under the sheath side wall and up into the cassette in the adjoining sheath through the liquid permeable light-trap at the bottom of the cassette. The liquid then flows upwards through the cassette and out through the material entry port, over the side wall of the adjoining sheath and down through the entry-port of the cassette in this sheath and down through the cassette. This flow pattern is continued depending on the number of sheaths in the device then the liquid is then sucked up from the bottom of the device into the channel by the pump.

Preferably the sheath(s) are made so that the thin cassette fits into the sheath with as little space as possible around the cassette but with a small area at the bottom of the sheath.

In the embodiment with a single sheath preferably means are provided for holding the sheath upright with its side walls upstanding. Most preferably a rack is provided which holds three of four sheaths. One sheath can contain, for example, developing solution, one stop solution and one fix solution and one can contain water. Most preferably however the pump is removed from the sheath which contains water and the sheath is connected directly to a tap water supply so that water is continuously fed through the sheath to an overflow.

The accompanying drawings will serve to illustrate the invention.

In all the drawings the same numbers have the same signification.

Figure 1:
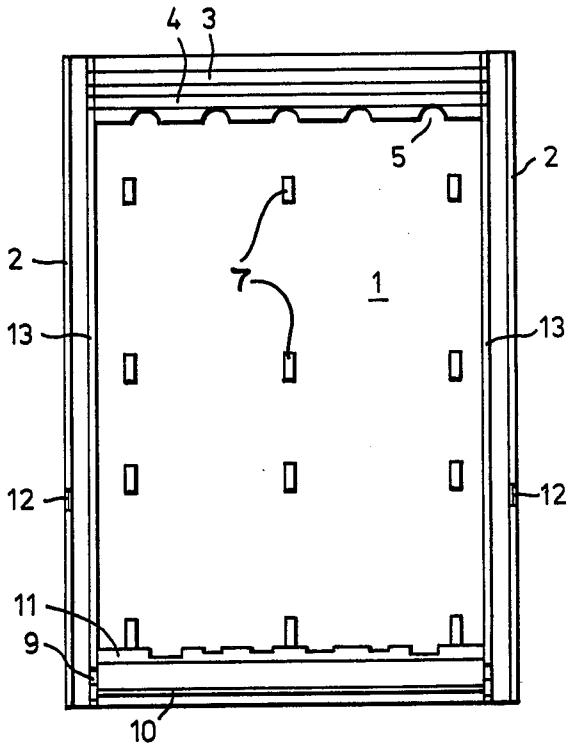
FIG. 1 is a top plan view of the underside of the floor panel of the cassette.

In FIG. 1 is shown the underside of the floor panel 1 of a photographic sheet material cassette. This panel has along two sides upstanding flanges 2. Located at the top of the figure are a pair of upstanding V-shaped elements 3 and 4 which when the cassette is assembled will constitute one half of the entry port. At the foot of V-shaped element 4 are holes 5 to allow air traped behind sheet material when present in the cassette to escape from behind the sheet.

Mounted on the floor of panel 1 are raised members 7 which serve to prevent sheet material from adhering to the underside of panel 1.

Located at the other end of panel 1 to the raised V-shaped members 3 and 4 is a trough 9 which is formed by a flange 10 and an indented flange 11. The indents in flange 11 are to allow any air trapped behind the sheet material when present to escape.

Figure 3:
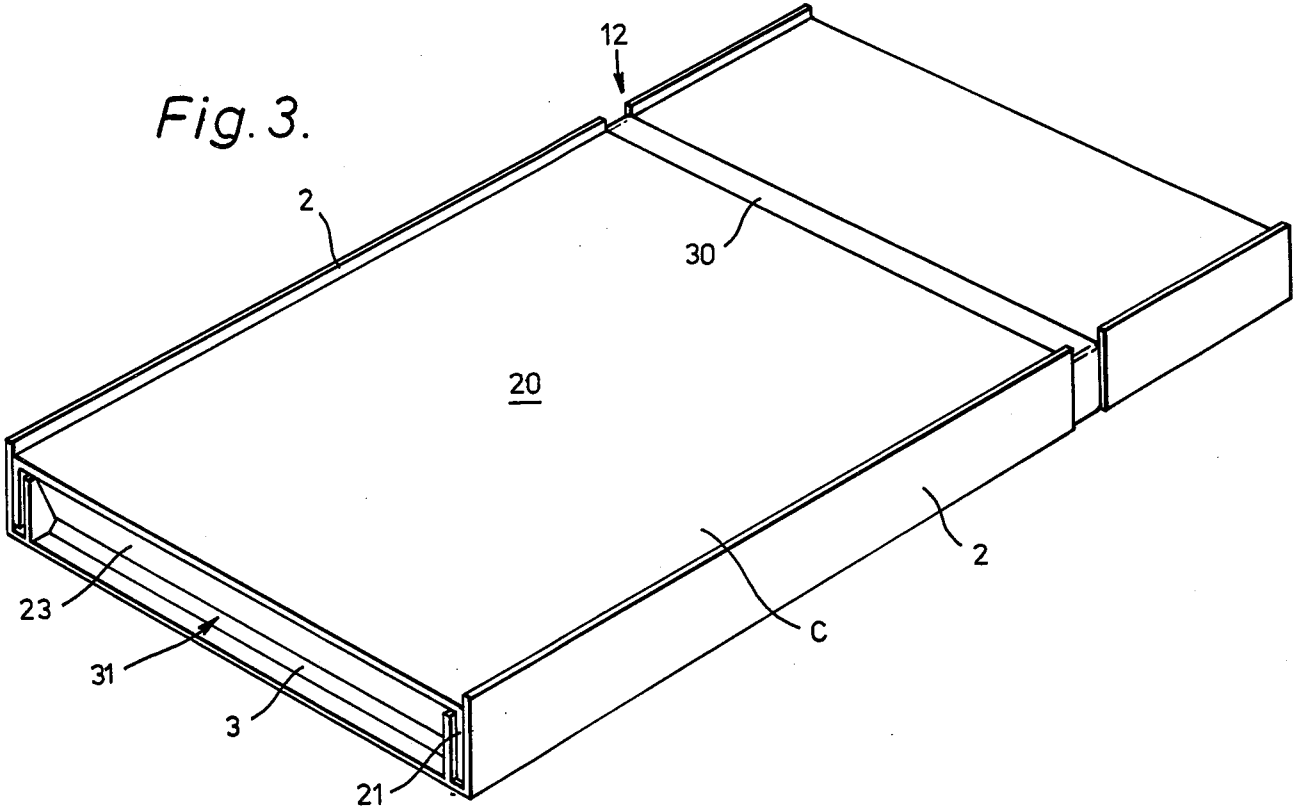
FIG. 3 is a perspective view of an assembled cassette according to the present invention.

On both side flanges 2 there is a notch 12. A rubber band as shown in FIG. 3 fits into these notches to hold the cassette together.

Inside the upstanding flanges 2 on each side of the panel is a lower flange 13 which cooperates with a flange on the top panel.

Figure 2:
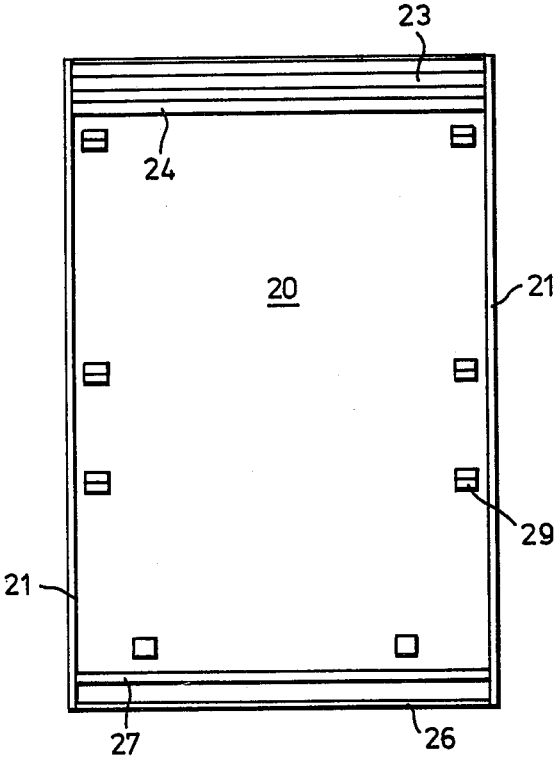
FIG. 2 is a top plan view of the underside of the top panel of the cassette.

In FIG. 2 there is shown the underside of the top panel 20 which has also along its two sides an upstanding flange 21. Located at the top end of the panel 20 are a pair of upstanding V-shaped elements 23 and 24.

Located at the other end of the cassette is an end-wall flange 26 and a thicker flange 27.

Mounted on the top panel 21 are a series of projections 29 which serve to prevent photographic sheet material adhering to the underside of the top panel.

Top panel 20 fits over floor panel 1 so that flange 21 on the top panel 20 lies between flanges 2 and 13 on the floor panel 1.

Flange 27 fits into trough 9 in panel 1 and end flange 26 lies adjacent to but not touching flange 10.

At the other end the pairs of upstanding V-shaped elements 3 and 4 and 23 and 24 fit together to form a light-tight but liquid permeable seal.

A rubber band is then placed round the assembled cassette being held in position by the notches 12 in the flanges 2 and by a recess in the top side of the floor panel 1 (not shown).

The cassette can then be opened sufficiently to insert a sheet of photographic material by pulling apart the two panels of the cassette against the pressure of the rubber band and causing the top panel to pivot on the floor panel.

In FIG. 3 there is shown an assembled cassette C composed of the two panels 1 and 20 held together by a rubber band 30.

Also there is shown the entry port 31 to the cassette. This is constituted by the V-shaped member 23 on the under-side of top panel 20 and the position of the panel 1 beyond the V-shaped member 3 on the floor panel.

In operation the cassette C is assembled and stored in the confines of the enlarger. After exposure the print material is slipped into the cassette and the cassette can then be withdrawn into the daylight. The material therein may be processed by standing the cassette in an outer sheath which contains processing liquid and causing processing liquid to flow through the cassette. It can be drained by lifting the cassette out of the sheath. It can then be placed in other solutions and finally in wash water.

In one design of daylight enlarger the cassette C is attached in a light-tight manner to the enlarger but external thereto. Exposed print material is slipped into the cassette from within the confines of the enlarger and the cassette can then be removed from contact with the enlarger and the print material therein processed.

Insert pieces can be placed in the cassette to enable print material of different sizes to be accomodated in the cassette.

Figure 4:
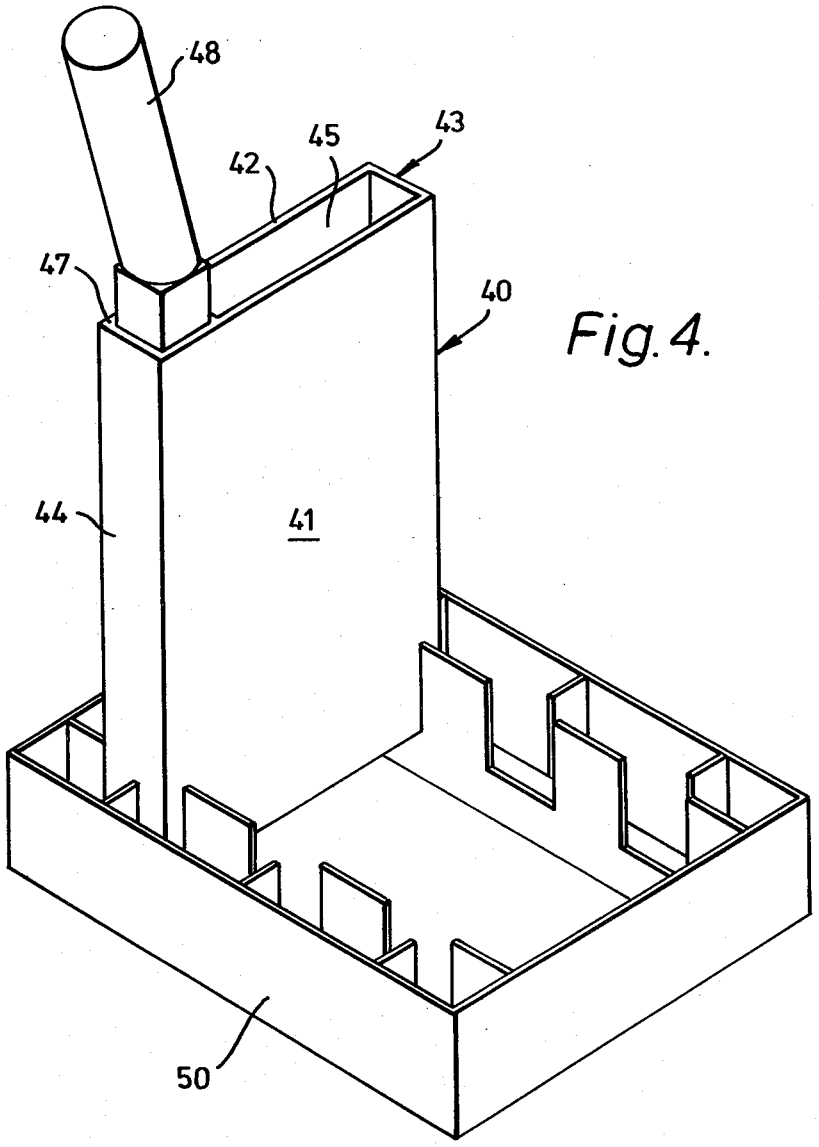
FIG. 4 is a perspective view of a processing device having a single sheath held in a stand.

In FIG. 4 the processing device comprises a thin sheath 40 with flat front 41 and back wall 42 and two side walls 43 and 44.

The top of the sheath is an open slot 45 but the bottom is closed to form a liquid container.

Figure 5:
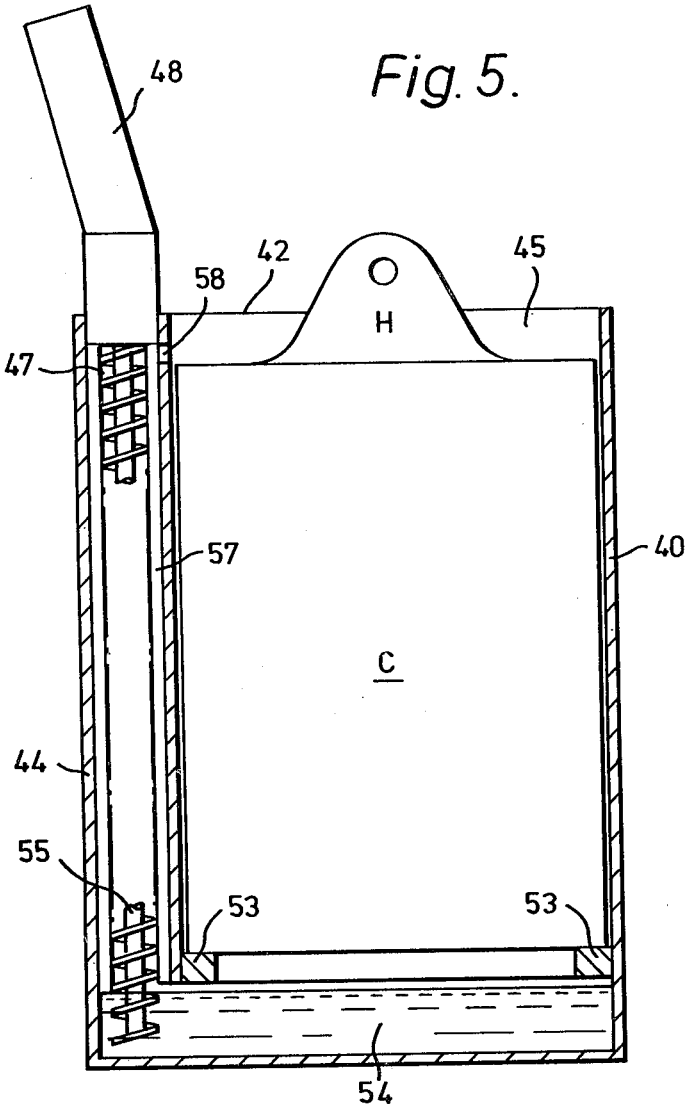
FIG. 5 is a cross-section side elevation of the processing device of FIG. 4 which contains the thin cassette of FIG. 3 having a handle attached thereto.

Present in a channel 47 on the left hand side of the sheath 40 is a battery operated pump 48 which is of the archimedian screw type as shown in FIG. 5.

The sheath 40 is present in a rack 50 which has provision for two more similar sheaths.

In FIG. 5 there is shown the thin cassette C of FIG. 3, to whicht there is attached a handle H, present in the sheath 40.

Cassette C rests on two abutment members 53 present in the sheath.

Below the cassette C there is shown a supply of processing liquid 54.

Shown in channel 47 on the left hand side is the pump 48 which has an archimedian screw 55 which extends down the channel. Along the sides of the channel are present vertical reacting members 57 which are present to enable the pump to suck liquid up the channel 47 from the supply of liquid 54 and discharge it near the top of the channel at the discharge port 58.

In operation the sheath 40 is stood in rack 50 and a supply of processing liquid is poured into the sheath.

A cassette C containing exposed photographic paper material is placed in the sheath with its handle H protruding. In practice the handle fits on the cassette only when the entry port of the cassette is facing upwards.

Pump 48 is then started and this causes liquid 54 to be sucked up the channel and discharged over the cassette entry port. The liquid then flows down the material in the cassette and leaves the cassette at the other end to the cassette entry port and joins the liquid 54 below the cassette.

When sufficient processing time has elapsed the cassette C is removed from the sheath 40 and placed in a similar sheath which contains a different processing liquid. When all the processing has finished the cassette C can be placed in a similar sheath which does not contain a pump but is connected to a supply of tap water. In this sheath the material in the cassette can be washed for suitable period of time.

Figure 6:
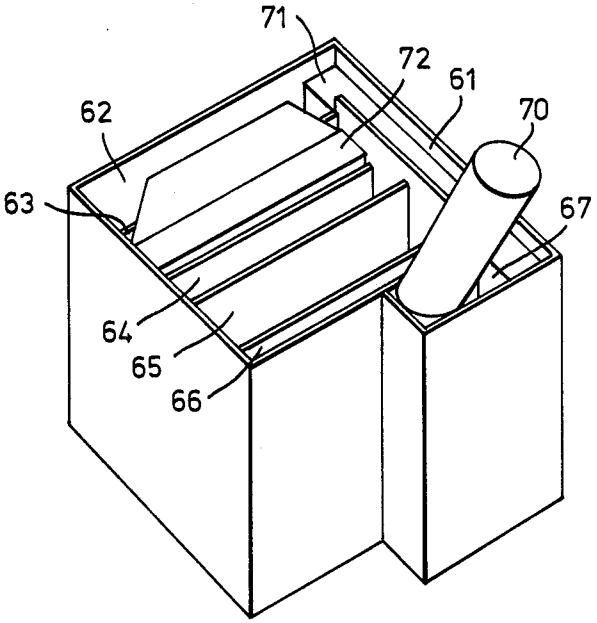
FIG. 6 is a perspective view of a processing device which has five sheaths.

In FIG. 6 the device comprises a container 61 which is divided into five sheaths 62–66. Located at one end of the container 61 is a compartment 67 which encloses an upward rising channel 69 (seen in FIG. 7) and the top of which is an archimedes pump 70. Reacting members are present in channel 69 but are not visible in either figure.

Present along the top of the container 61 is a liquid distribution channel 71 through which liquid flows to re-enter the sheath-system at the top of sheath 62.

There is shown in sheath 62 a cassette 72. Single cassettes can be processed in this apparatus and they would preferably be placed in sheath 63.

Figure 7:
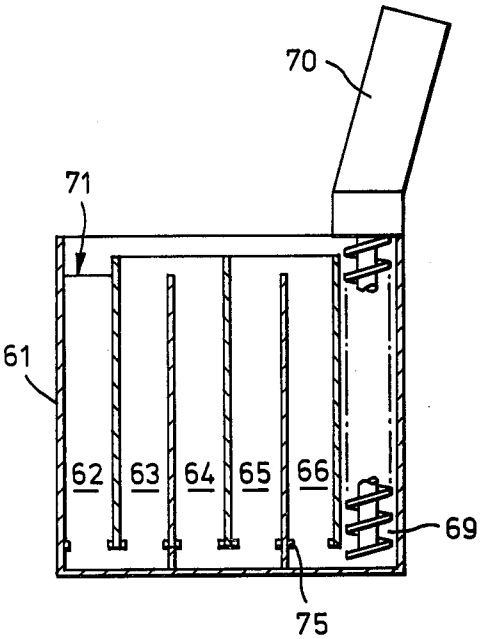
FIG. 7 is a cross-sectional side view of the device of FIG. 6 showing the liquid flow therein.

FIG. 7 shows the direction of flow of the liquid in container 61.

There is also shown in FIG. 7 the flange members 75 two of which are present in each sheath and which prevent the cassettes from resting on the bottom of the container 61.

Thus in operation liquid is sucked up channel 69 by pump 70 and then flows out of the top of channel 69 into channel 71 to sheath 62. It flows down sheath 62 under the dividing wall to sheath 63 and up sheath 63, over the dividing wall into sheath 64, down sheath 64, under the dividing wall to sheath 65, up sheath 65, over the dividing wall to sheet 66, down sheath 66 where it is sucked up channel 69 again by the pump. Thus a good circulation of processing liquid present in the container 61 is obtained.

I claim:

1. A photographic sheet material processing device comprising a cassette which is composed of a light opaque material and which comprises a substantially flat floor panel with upstanding side flanges along two parallel sides and a substantially flat top panel with downward projecting side flanges along two parallel sides, said downward projecting side flanges fitting within the side flanges in the floor panel to form side walls and to cover the floor panel, the floor and top panels together with their side walls forming a cassette in which a sheet of photographic material can be accomodated, the cassette being characterized in that the top panel is pivotally mounted on the floor panel at one end of the cassette and is held in contact with the floor panel by a resilient band which surrounds the cassette so that the other end of the cassette can be opened sufficiently to allow a sheet of photographic material to be inserted into the cassette or removed therefrom by inverting the cassette, there being present light-sealing means along both sides of the cassette and there being present light-sealing but liquid permeable means at both ends of the cassette.

2. A device according to claim 1 characterised in that the resilient band surrounds the cassette towards the end at which the cassette pivots.

3. A device according to claim 2 characterized in that the resilient band is located in notches in the side flanges on the floor panel.

4. A device according to claim 1 characterised in that the light sealing means along the sides of the cassette comprises a flange along both side edges of the top panel of the cassette which cooperate with internal flanges on the floor panel.

5. A device according to claim 1 characterised in that the pivotal mounting of the top panel in the floor panel comprises a trough in the floor panel into which a flange on the top panel fits and this together with an external flange on the top panel constitutes also the light-sealing but liquid permeable means at this end of the cassette.

6. A combined processing device and cassette comprising at least one thin open-ended flat-sided sheath and a cassette according to claim 1 fitted therein, said sheath containing means for preventing the cassette from sitting on the bottom thereof and pump means attached thereto which is adapted to pump liquid from the bottom of the sheath and discharge it at the top of the sheath.

7. A device according to claim 6 which is characterized in that said sheath contains a liquid channel and said pump is attached at the top of said liquid channel.

8. A device according to claim 7 characterised in that the pump is located at one side of the sheath at the top of the liquid channel.

9. A device according to claim 6 further comprising an open container for housing at least three sheaths arranged in seriatrim in parallel across the container.

10. A device according to claim 9 characterized in that said container has a channel in which said pump is positioned.

11. A device according to claim 9, wherein said container has a liquid distribution channel positioned along the top thereof for introducing liquid into the sheaths.

* * * * *